US007388180B2

(12) United States Patent
Kim et al.

(10) Patent No.: US 7,388,180 B2
(45) Date of Patent: Jun. 17, 2008

(54) MICROWAVE OVEN HAVING A DRIVING UNIT FOR MOVING AND ROTATING AN ANTENNA

(75) Inventors: Eung Su Kim, Seoul (KR); Kwang Yong Kim, Seoul (KR); Young Min Lee, Incheon-Si (KR)

(73) Assignee: LG Electronics Inc., Seoul (KR)

( * ) Notice: Subject to any disclaimer, the term of this patent is extended or adjusted under 35 U.S.C. 154(b) by 142 days.

(21) Appl. No.: 11/390,363

(22) Filed: Mar. 28, 2006

(65) Prior Publication Data

US 2006/0289534 A1 Dec. 28, 2006

(30) Foreign Application Priority Data

Mar. 29, 2005 (KR) ..... 10-2005-0026040

(51) Int. Cl.
*H05B 6/72* (2006.01)

(52) U.S. Cl. ..... 219/749; 219/695

(58) Field of Classification Search ..... 219/745–751, 219/695–697, 756
See application file for complete search history.

(56) References Cited

U.S. PATENT DOCUMENTS 4,424,430 A * 1/1984 Almgren et al. ..... 219/749
4,904,835 A * 2/1990 Koch et al. ..... 219/701
6,274,859 B1 * 8/2001 Yoshino et al. ..... 219/746

FOREIGN PATENT DOCUMENTS

KR 2003061865 * 7/2003

* cited by examiner

*Primary Examiner*—Philip H Leung
(74) *Attorney, Agent, or Firm*—Birch, Stewart, Kolasch & Birch, LLP

(57) ABSTRACT

A microwave oven includes a cooking chamber; a magnetron for generating a microwave; a waveguide for guiding the microwave from the magnetron toward the cooking chamber; an antenna between the cooking chamber and the waveguide for propagating the microwave guided by the waveguide into the cooking chamber; and a driving unit for moving the antenna along a first direction and rotating the antenna.

5 Claims, 9 Drawing Sheets

MICROWAVE OVEN HAVING A DRIVING UNIT FOR MOVING AND ROTATING AN ANTENNA

CROSS-REFERENCE TO RELATED APPLICATION

This Nonprovisional Application claims priority under 35 U.S.C. §119(a) on Patent Application No. 10-2005-0026040 filed in Korea on Mar. 29, 2005, the entire contents of which are hereby incorporated by reference.

BACKGROUND OF THE INVENTION

1. Field of the Invention

The present invention relates to microwave ovens, and more particularly, to a microwave oven in which a microwave from a magnetron propagates uniformly throughout an entire area of a cooking chamber in which food is cooked, to improve a cooking performance.

2. Discussion of the Related Art

In general, the microwave oven generates the microwave from electricity and directs the microwave to food to generate heat inside of the food by molecular vibration, to heat the food within a short time period.

A related art microwave oven will be described with reference to the attached drawings. FIG. 1 illustrates a perspective view of a related art microwave oven. FIG. 2 illustrates a section of a related art microwave oven.

Referring to FIGS. 1 and 2, the related art microwave oven is provided with a cooking chamber 4 having a turntable 6 for placing food (not shown) thereon, a cabinet 2 outside the cooking chamber 4 having a control unit 28 for operating the microwave oven, and a door 10 rotatably mounted on the cabinet 2 having a look-through window 8.

The turntable 6 is rotatably supported on a plurality of rollers 12 secured to a rotation ring 14 at the bottom of the cooking chamber 4, and the rotation ring 14 has a center portion connected to a rotation shaft 17 of a driving motor 16 between the bottom of the cooking chamber 4 and the cabinet 2.

The cabinet 2 is provided with a magnetron 20 for generating the microwave, a heat dissipation fan (not shown) and a motor (not shown) for dissipating heat from the magnetron 20, and a waveguide 24 between the magnetron 20 and the cooking chamber 4.

In the related art microwave oven, the user places food intended to cook on the turntable 6, closes the door 10, and operates the controller 28 to cook the food. Then, the microwave is directed from the magnetron 20 to the cooking chamber 4 through the waveguide 24, and the microwave propagates through the food, to heat and cook the food.

In this instance, the rotation ring 14 and the rollers 12 rotate under the turntable 6 following rotation of the driving motor 16, and the food on the turntable 6 is heated as the turntable 6 and the food rotate together with the rollers 12.

However, in the related art microwave oven, since the turntable 6 rotates around the rotation shaft 17 of the driving motor 16 only, the food also rotates along a fixed rotation locus. Consequently, the microwave fails to reach to the food uniformly, thereby impairing cooking performance.

Moreover, the turntable 6, the rollers 12, and the rotation ring 14 in the cooking chamber 4 in which the food is to be cooked impede cleaning the cooking chamber 4. Particularly, if the food breaks away from the turntable 6, and sticks to the rollers 12, the rotation ring 14, etc., it is inconvenient for the user to remove the turntable 6 in order to clean the rollers 12 and the rotation ring 14.

Moreover, the size and the shape of the food to be introduced in the cooking chamber 4 are limited by the size and the shape of the turntable 6. Therefore, it is required to take the rotation of the turntable 6 into account before introducing the food into the cooking chamber 4.

SUMMARY OF THE INVENTION

Accordingly, the present invention is directed to a microwave oven that substantially obviates one or more problems due to limitations and disadvantages of the related art.

An object of the present invention is to provide a microwave oven which can make the microwave propagate to an entire area of a cooking chamber uniformly, for improving a cooking performance, increasing the space of the cooking chamber, and facilitating the cleaning process.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a microwave oven including a cooking chamber; a magnetron for generating a microwave; a waveguide for guiding the microwave from the magnetron toward the cooking chamber; an antenna between the cooking chamber and the waveguide for propagating the microwave guided by the waveguide into the cooking chamber; and a driving unit for moving the antenna along a first direction and rotating the antenna.

In another aspect of the present invention, a method for distributing a microwave for cooking in a microwave oven, comprises the steps of: generating a microwave; guiding the microwave via a waveguide toward a cooking chamber of the microwave oven; and rotating an antenna between the cooking chamber and the waveguide and moving the antenna in a first direction to propagate the microwave guided by the waveguide into the cooking chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the embodiments of the present invention, examples of which are illustrated in the accompanying drawings. Wherever possible, the same reference numbers will be used throughout the drawings to refer to the same or like parts.

Figure 1:
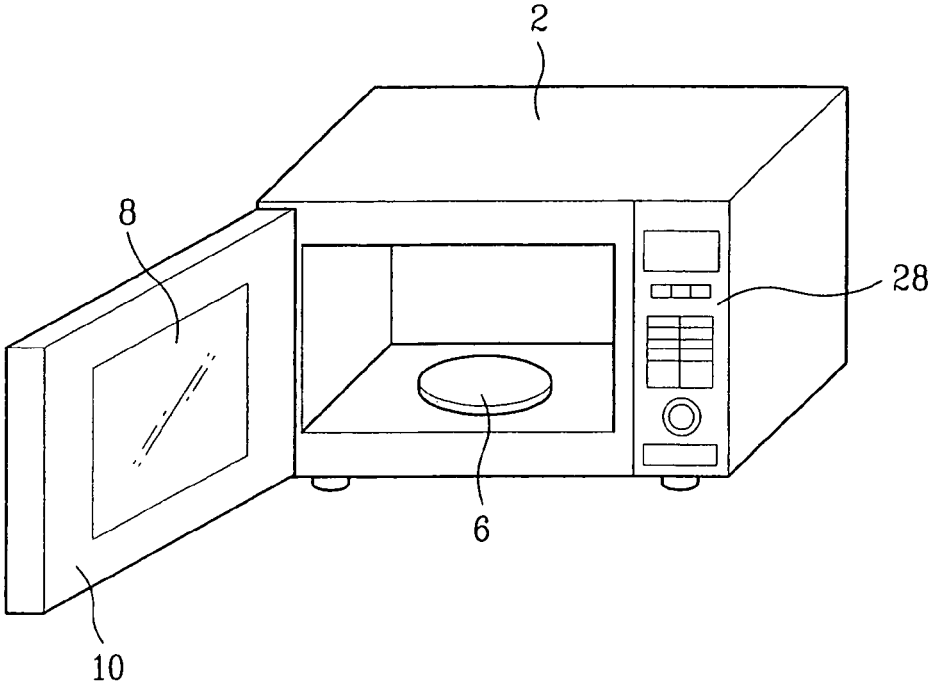
FIG. 1 Related Art
FIG. 1 illustrates a perspective view of a related art microwave oven.
Figure 2:
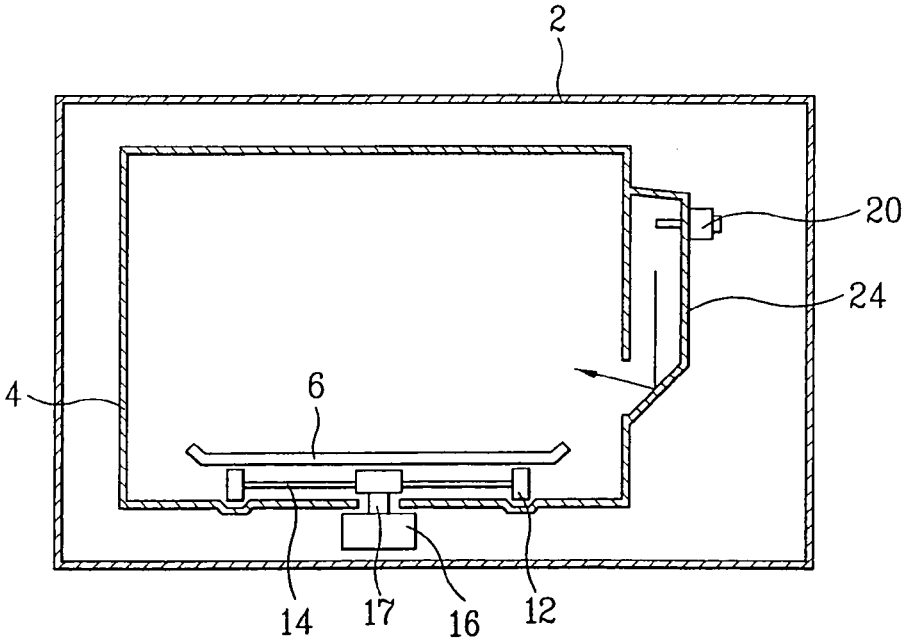
FIG. 2 Related Art
FIG. 2 illustrates a section of a related art microwave oven.
Figure 3:
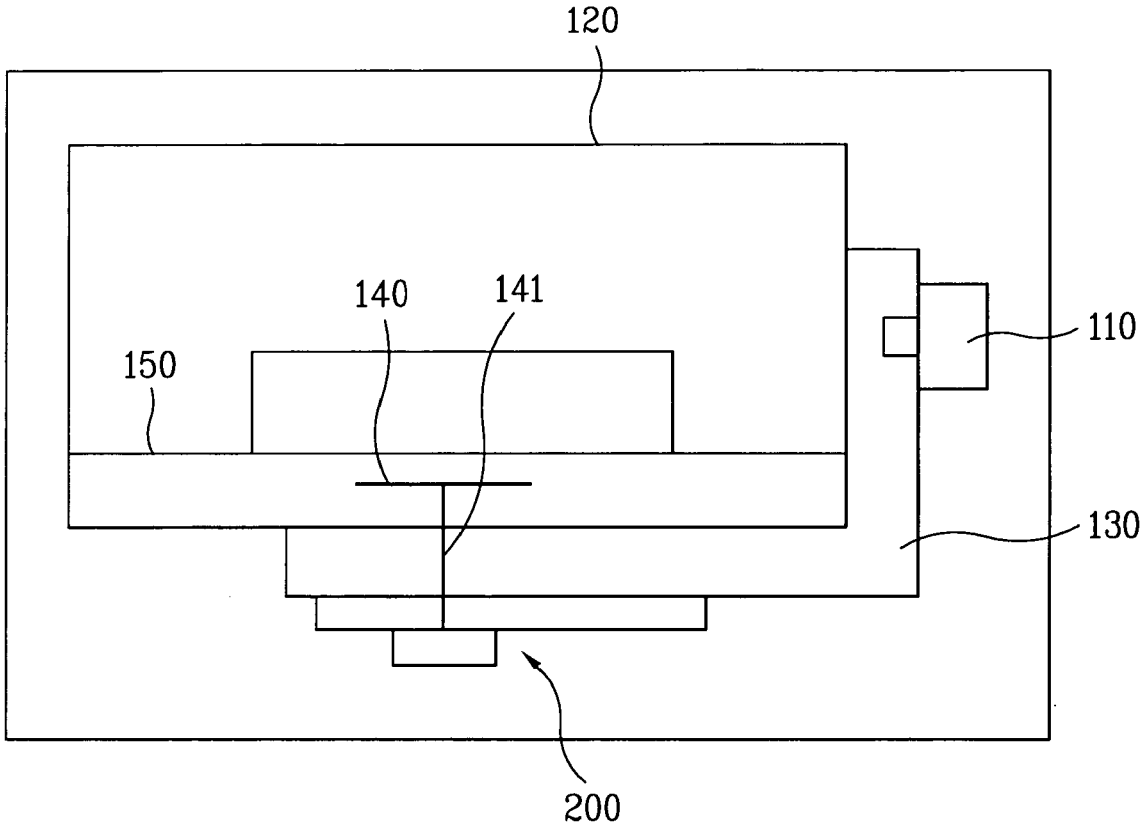
FIG. 3 illustrates a diagram of a microwave oven in accordance with a first embodiment of the present invention.
Figure 4:
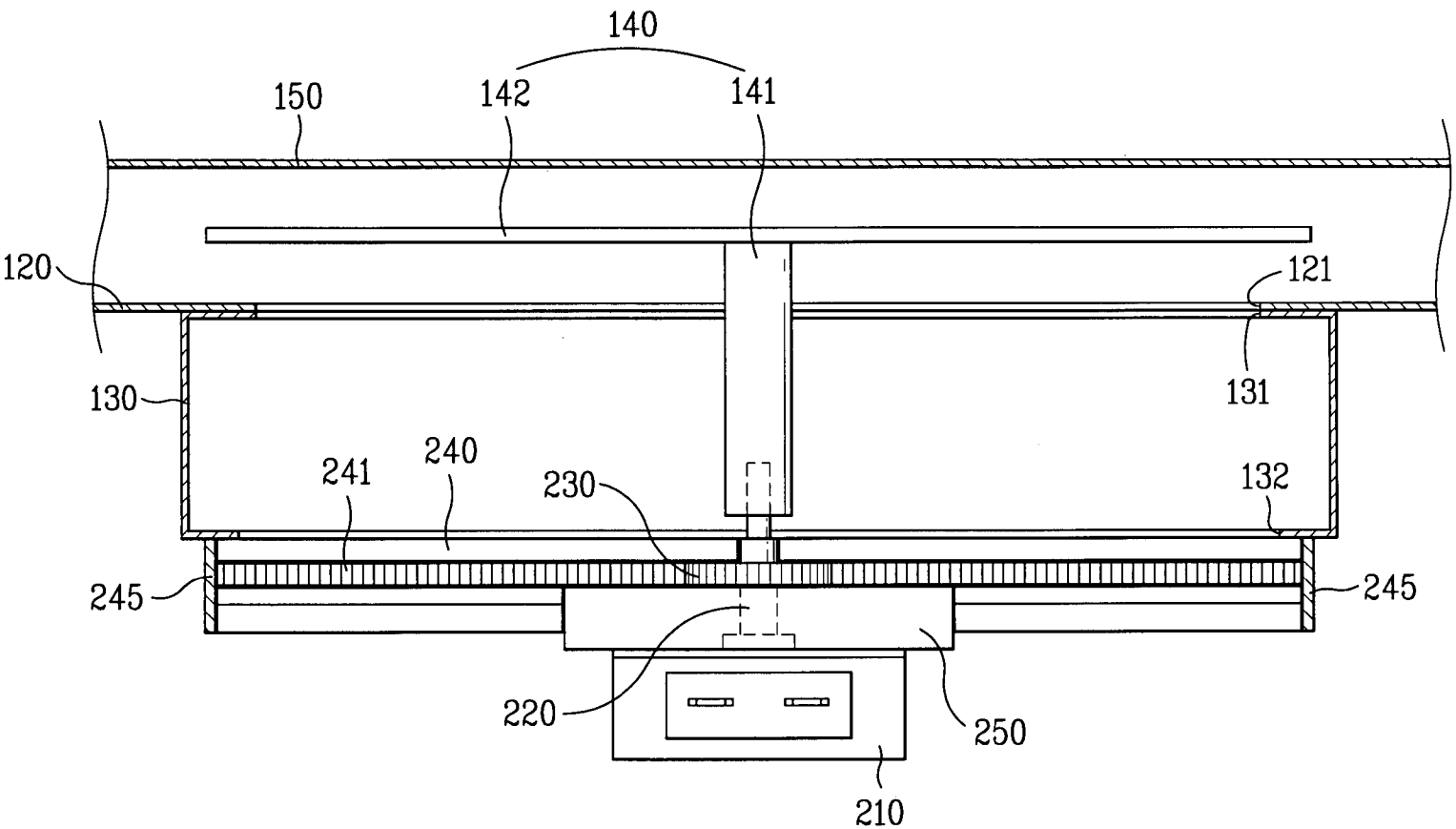
FIG. 4 illustrates a front section showing some parts in FIG. 3.
Figure 5:
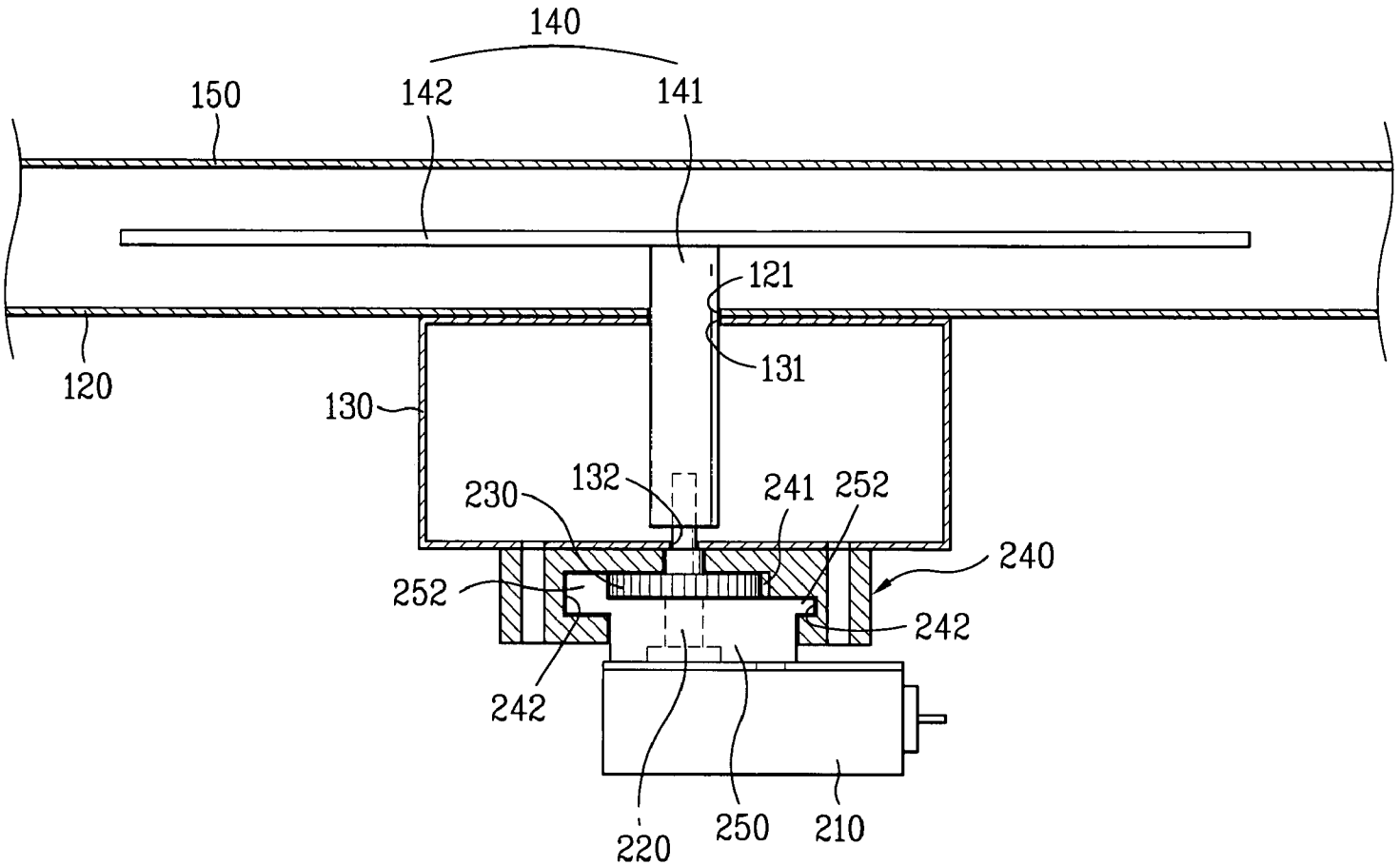
FIG. 5 illustrates a side section showing some parts in FIG. 3.
Figure 6:
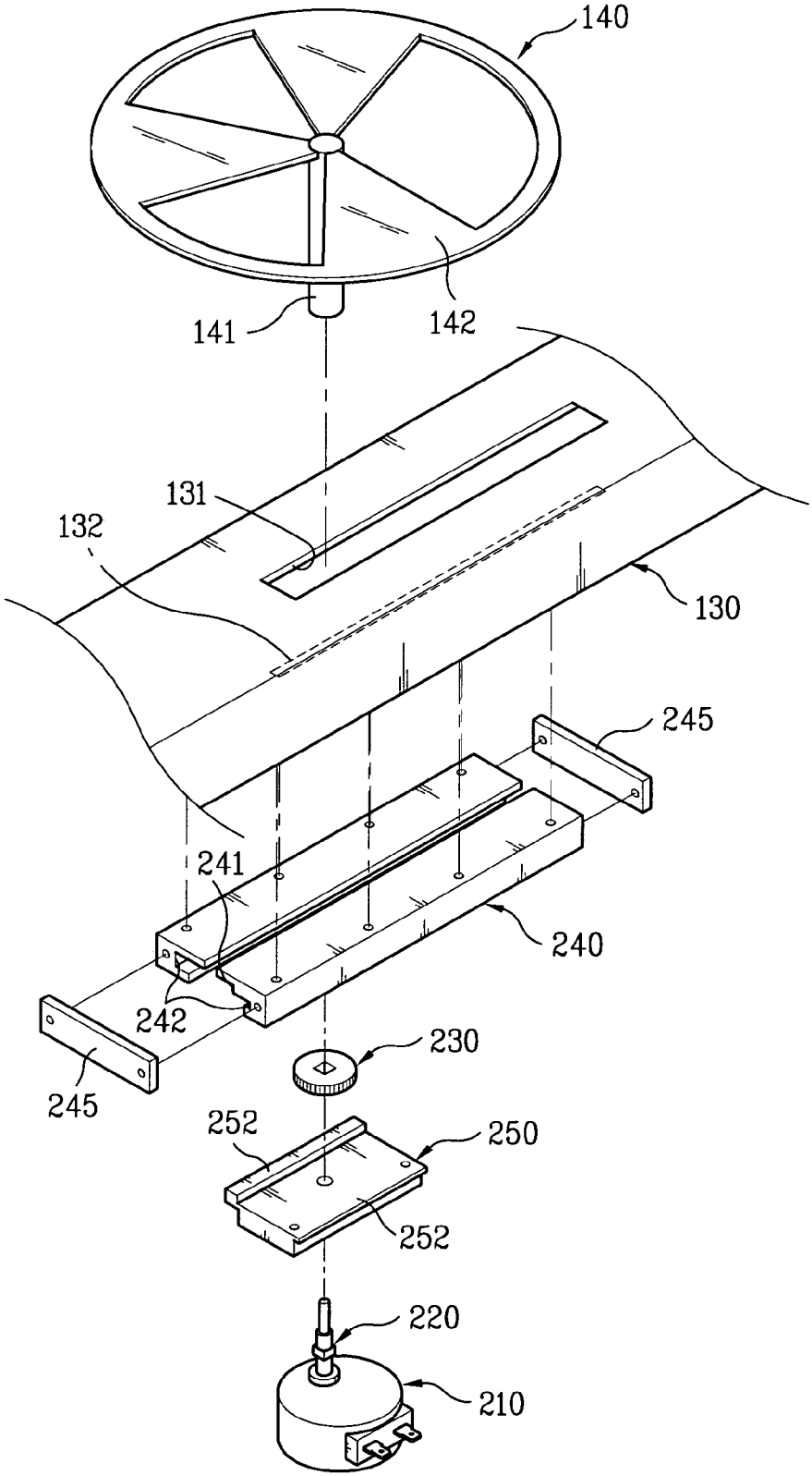
FIG. 6 illustrates a perspective exploded view showing some parts in FIG. 3.

FIG. 3 illustrates a diagram of a microwave oven in accordance with a first embodiment of the present invention. FIG. 4 illustrates a front section showing some parts in FIG. 3. FIG. 5 illustrates a side section showing some parts in FIG. 3. FIG. 6 illustrates a perspective exploded view showing some parts in FIG. 3. Referring to FIGS. 3-6, the microwave oven includes a cooking chamber 120, a magnetron 110, a waveguide 130, an antenna 140, a flat plate 150, and a driving unit 200.

The cooking chamber 120 forms a space for cooking food. The magnetron 110 is outside the cooking chamber 120, for generating the microwave to cook the food. The waveguide 130 between the magnetron 110 and the cooking chamber 120 for guiding the microwave from the magnetron 110 into the cooking chamber 120. The antenna 140 between the cooking chamber 120 and the waveguide 130 propagates the microwave guided by the waveguide into the cooking chamber 120.

The flat plate 150 is over the antenna 140 for placing food thereon in the cooking chamber 120. The flat plate 150 is formed of a material through which the microwave supplied into the cooking chamber 120 by the antenna 140 is transmissive.

The driving unit 200 includes a guide member 240 having a motor 210, a motor shaft 220, a pinion 230, and a rack 241, and a slide member 250, for rotating and reciprocally moving the antenna 140.

The motor 210 is a reversible synchronous motor which reverses if an interference torque is applied thereto. The motor shaft 220 is connected to the shaft 141 of the antenna 140, for transmitting a rotation force from the motor 210 to the shaft 141 of the antenna 140.

The pinion 230 is fixed to the motor shaft 220, to rotate together with the motor shaft 220. The guide member 240 is fastened to the bottom surface of the waveguide 130 outside the waveguide 130, and has a rack 241 formed thereon corresponding to the pinion 230. The guide member 240 may have one or more parts for guiding the rotation and reciprocation of the pinion 230.

The slide member 250 is slidably mounted between the guide member 240 and the pinion 230, and has the motor 210 secured thereto. The motor shaft 220 passes through the slide member 250, and is connected to the shaft 141 of the antenna 140.

The guide member 240 and the slide member 250 have a guide groove 242 and a guide projection 252 in complementary to each other for supporting the slide member 250 on the guide member 240, and enabling sliding of the slide member 250.

Meanwhile, at the top end of the shaft 141 of the antenna 140, there is a substantially circular propagation portion 142 for uniform propagation of the microwave into the cooking chamber 120. The bottom end of the antenna 140 is positioned inside the waveguide 130, and connected to one end of the motor shaft 220 fixed to the pinion 230. The circular propagation portion 142 in the illustrated embodiment is a circular shutter wheel having a plurality of opening portions for passing through the microwave and a plurality of blocking portions for blocking the microwave. It should be noted that the antenna in the illustrated embodiment is simply an example to illustrate the present invention. The circular propagation portion 142 can also be different types and/or have different shapes. For example, the circular propagation portion 142 may includes one or more slits, slots, holes, and/or other types of openings to pass through the microwave. The circular propagation portion 142 may also have different shapes, such as square, rectangular, oval, or irregular shapes other than the circular shape in the illustrated embodiment.

In order to enable the reciprocation of the shaft 141 of the antenna 140, and the motor shaft 220, there are slots 131 and 132 at the upper and lower surfaces of the waveguide 130, as well as a slot 121 at the lower surface of the cooking chamber 120.

In the meantime, there are end covers 245 at opposite ends of the guide member 240 at the length direction of the guide member 240, for preventing the slide member 150 from falling off during reciprocation.

Though not shown, the driving unit 200 may also be mounted over the cooking chamber 120.

The operation of the foregoing microwave oven in accordance with a first embodiment of the present invention will be described.

If the microwave oven operates with food placed on the flat plate 150, the microwave is generated at the magnetron 110 and transmitted along the waveguide 130, and propagates into the cooking chamber 120 through the antenna 140.

In this instance, the antenna 140 coupled to the motor 210 rotates and at the same time reciprocally moves along the rack 241 following the rotation of the motor 210, to propagate the microwave into the cooking chamber 120 uniformly.

Accordingly, the microwave uniformly propagated into the cooking chamber 120 permeates through the entire food uniformly, thereby heating and cooking the food uniformly.

Figure 7:
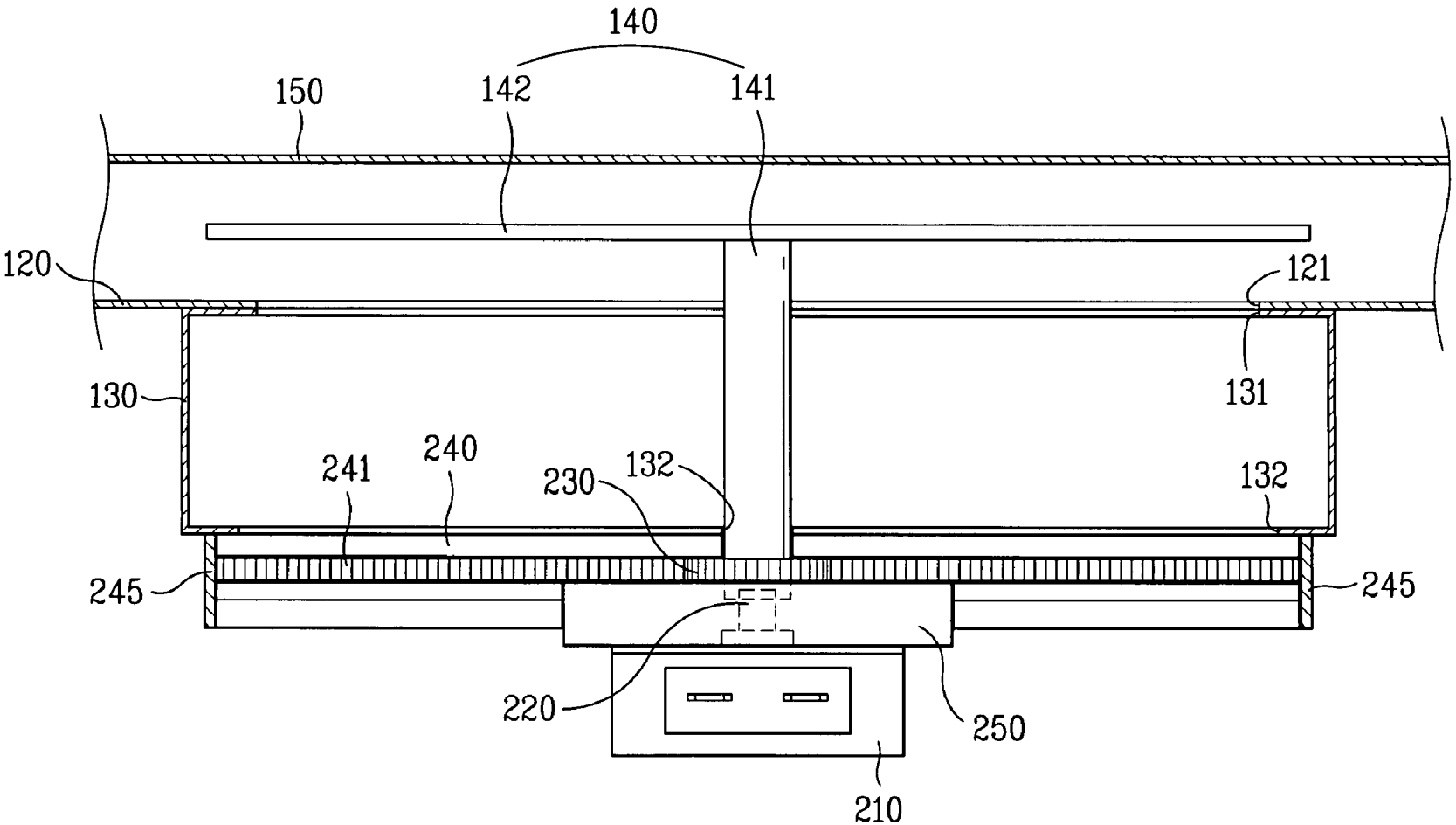
FIG. 7 illustrates a front section of a microwave oven in accordance with a second embodiment of the present invention.

A microwave oven in accordance with a second embodiment of the present invention will be described with reference to FIGS. 7 and 8. FIG. 7 illustrates a front section of a microwave oven in accordance with a second embodiment of the present invention and FIG. 8 illustrates a side section showing some parts in FIG. 7.

The microwave oven in accordance with a second embodiment of the present invention includes the pinion 230 provided to the outer circumferential surface of the shaft 141 of the antenna 140. The antenna 140 at the lower end of the shaft 141 thereof is connected to the motor 210 at the motor shaft 220 thereof.

Figure 8:
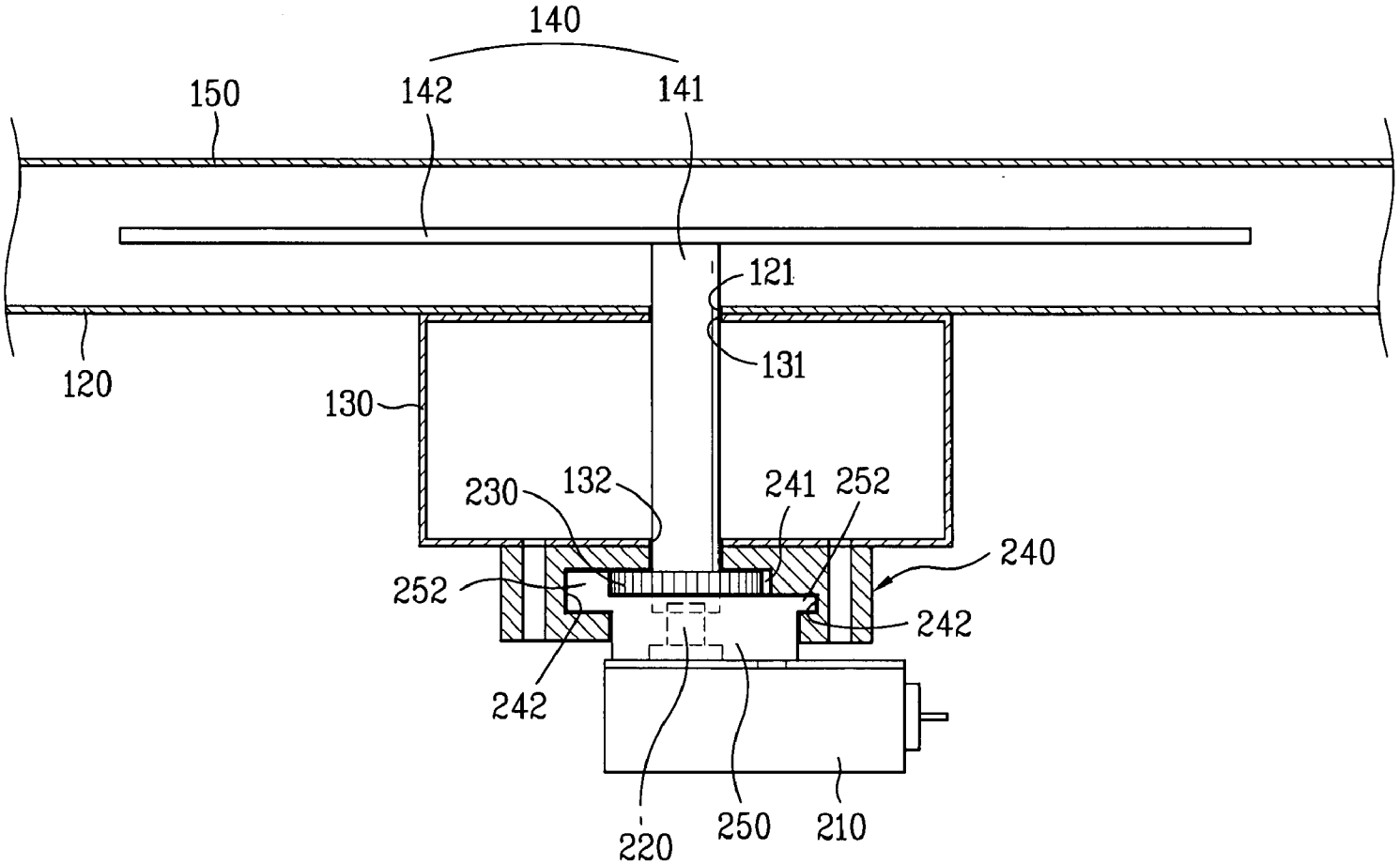
FIG. 8 illustrates a side section showing some parts in FIG. 7.

That is, referring to FIGS. 7 and 8, the shaft 141 of the antenna 140 passes through the pinion 230, and the lower end of the shaft 141 of the antenna 140 projects through the lower surface of the waveguide 130, and is connected to the motor rotation shaft 220 directly. In order to reciprocally move the shaft 141 of the antenna 140, the waveguide 130 has slots 131 and 132 at its upper and lower surfaces thereof respectively, and the cooking chamber 120 also has a slot 121 at its lower surface.

Because the structure and operation of the microwave oven of the second embodiment of the present invention are similar to the first embodiment except the above, the detailed description of other portion of the second embodiment will not be given.

Figure 9:
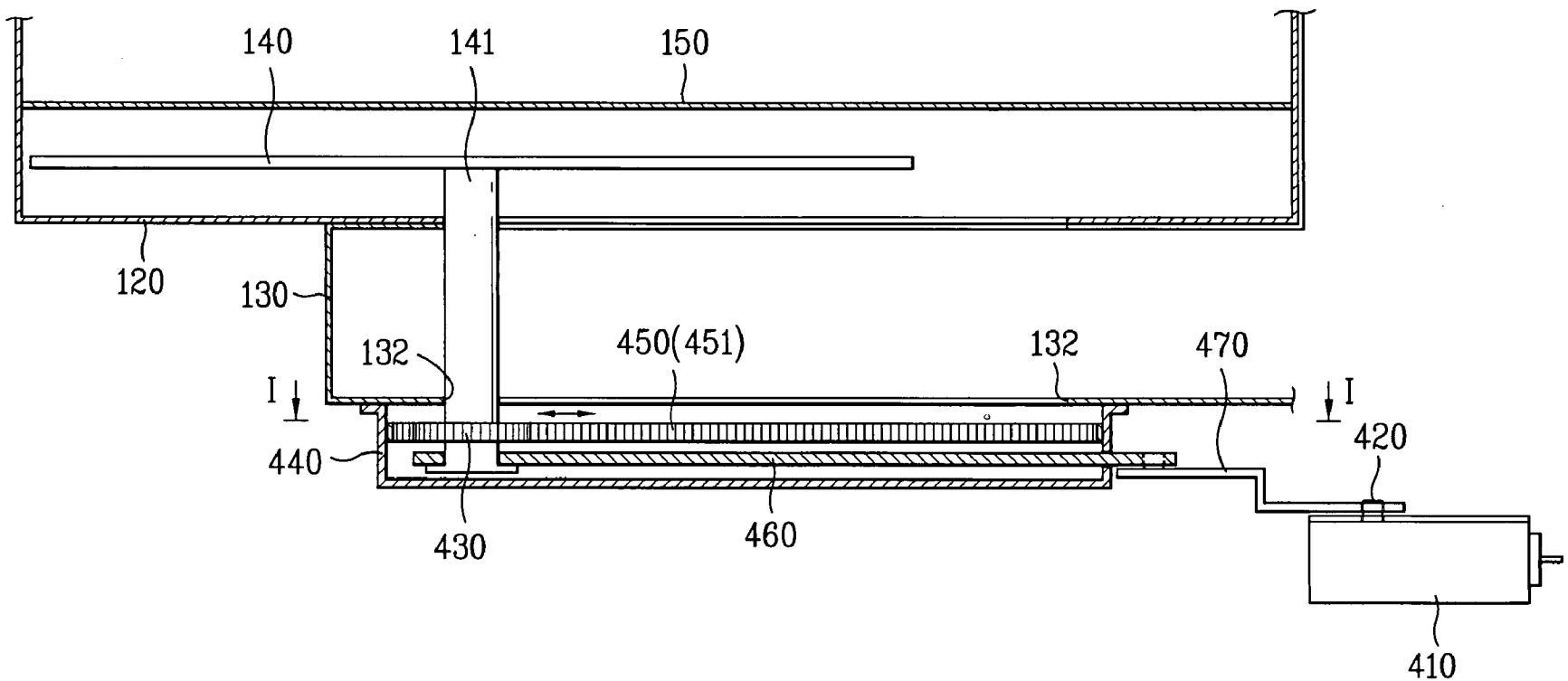
FIG. 9 illustrates a front section of a microwave oven in accordance with a third embodiment of the present invention.
Figure 10:
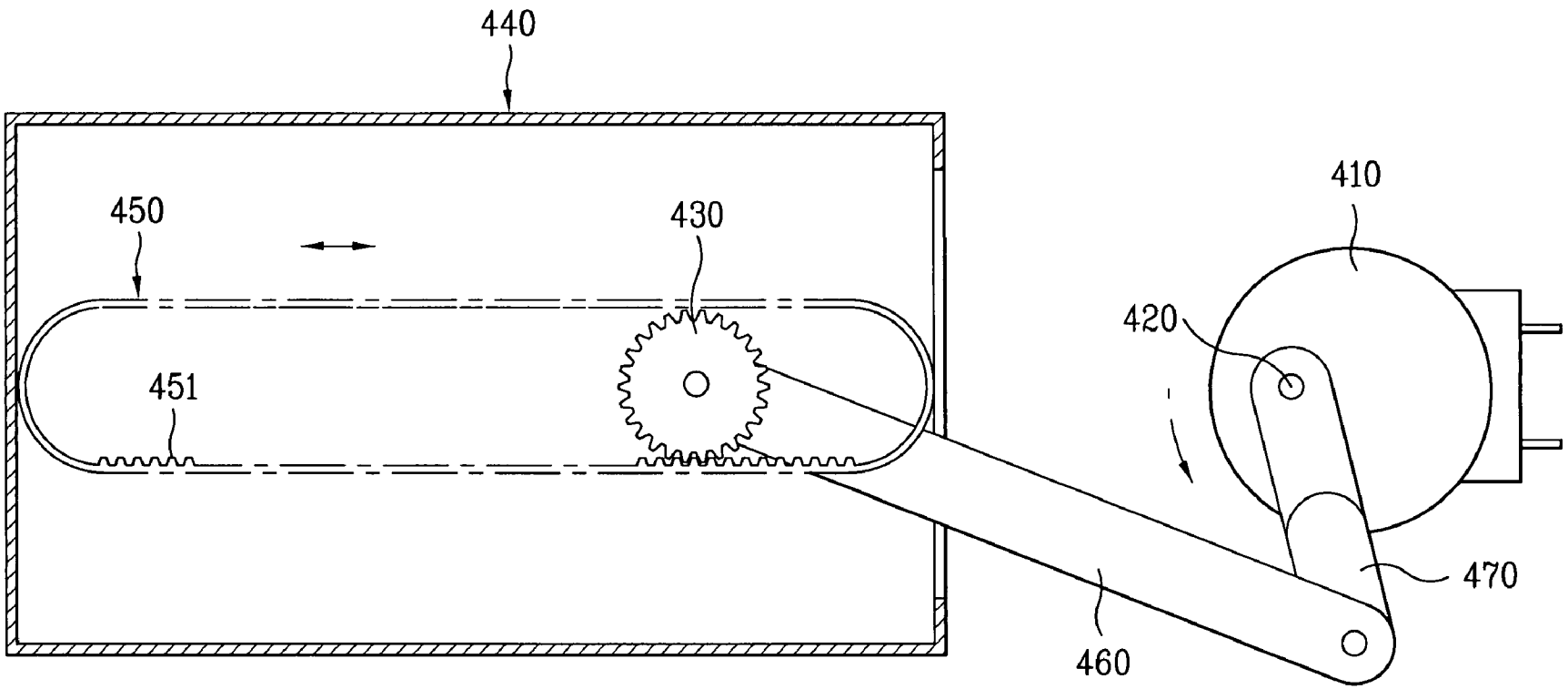
FIG. 10 illustrates a cross-sectional view along the line I-I in FIG. 9.

A microwave oven in accordance with a third embodiment of the present invention will be described with reference to FIGS. 9 and 10. FIG. 9 illustrates a front section of a microwave oven in accordance with a third embodiment of the present invention. FIG. 10 illustrates a cross-sectional view along the line I-I in FIG. 9.

Similar to the first embodiment of the present invention, the microwave oven in accordance with a third embodiment of the present invention includes the cooking chamber 120, the magnetron 110, the waveguide 130, the antenna 140, and the flat plate 150. However, the microwave oven of the third embodiment has a different driving unit for rotating and reciprocally moving the antenna 140.

Referring to FIGS. 9 and 10, the driving unit in the third embodiment includes a motor 410, a motor shaft 420, a pinion 430, a housing 440, a guide member 450, a connection link 460, and a rotation link 470.

The motor 410 rotates in one direction, and is provided with a motor shaft 420 for transmitting a rotation force. The pinion 430 is mounted to the outer circumferential surface of the shaft 141 of the antenna 140.

The housing 440 has an opened upper surface for receiving the lower end of the shaft 141 of the antenna 140 projected outwardly through the lower surface of the waveguide 130.

The guide member 450 is fixedly secured inside the housing 440, and has a rack 451 arranged in a length direction corresponding to the pinion 430. The connection link 460 has one end swingably connected to the lower end of the shaft 141 of the antenna 140, and the other end extended as a free end. The rotation link 470 has one end swingably connected to the other end of the connection link 460, and the other end connected to the motor shaft 420 of the motor 410.

At the bottom surface of the cooking chamber 120, and the upper and lower surfaces of the waveguide 130, there are slots 121, 131, and 132 respectively to allow the shaft 141 of the antenna 140 to reciprocally move along the slots.

In the meantime, though the pinion 430 may be formed separate from the shaft 141 of the antenna 140 and fixedly secured to the outer circumferential surface of the shaft 141, in the third embodiment of the present invention, the pinion 430 is formed as an integral, single unit with the shaft 141 of the antenna 140, so that the pinion 430 is engaged with the rack 451 of the guide member 450 to rotate and reciprocally move together with the shaft 141 of the antenna 140.

The guide member 450 has a hollow space in the length direction of the guide member 450 for guiding the reciprocation of the shaft 141 of the antenna 140. The rack 451 is at the sidewall of the hollow space, and is engaged with the pinion 430.

The connection link 460 has a lower end swingably connected to a lower end of the shaft 141 of the antenna 140, and the other end extended toward the motor 410 through an opening 441 in a side surface of the housing 440.

The rotation link 470 has one end swingably coupled to the other end of the connection link with a shaft, and the other end secured to a motor shaft 420 of the motor 410. The rotation link 470 has a length shorter than the connection link 460, for smooth reciprocation of the connection link 460 when the rotation link 470 rotates.

The operation of the microwave oven in accordance with the third embodiment of the present invention will be described.

Upon operating the microwave oven with food placed on the flat plate 150, the microwave oven is generated at the magnetron 110 and transmitted along the waveguide 130, and propagates into the cooking chamber 120 through the antenna 140.

In this instance, as the motor 410 of the driving unit rotates, the rotation link 470 connected to the motor shaft 420 rotates while drawing a certain locus and to reciprocate the connection link 460 in a left/right direction to reciprocate the shaft 141 of the antenna 140.

At the same time, the pinion 430, engaged with the rack 451 of the guide member 450, rotates to rotate the shaft 141 of the antenna 140. At the end, the antenna 140 simultaneously rotates and moves reciprocally, making the microwave propagate into the cooking chamber 120 uniformly.

As described, the microwave oven of the illustrated embodiments has the following advantages.

The simultaneous rotation and reciprocation of the antenna provide uniform propagation of the microwave from the magnetron into an entire area of the cooking chamber. Accordingly, the microwave can permeate through the food uniformly to improve a cooking performance.

The flat plate inside the cooking chamber, making a bottom surface of the cooking chamber flat. Therefore, it provides an efficient use of the interior space of the cooking chamber. Moreover, the flat bottom surface of the cooking chamber provides a better look and facilitates cleaning.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A microwave oven, comprising:

a cooking chamber;

a magnetron for generating a microwave;

a waveguide for guiding the microwave from the magnetron toward the cooking chamber;

an antenna between the cooking chamber and the waveguide for propagating the microwave guided by the waveguide into the cooking chamber; and a driving unit for moving the antenna along a first direction and rotating the antenna, wherein the driving unit includes:

a motor to rotate the antenna;

a pinion rotatably connected to a shaft of the antenna;

a guide member on the waveguide, the guide member having a rack corresponding to the pinion to guide the pinion to reciprocally move the antenna along the rack in the first direction;

a connection link swingably connected to a lower end of the shaft of the antenna; and a rotation link swingably connected to the connection link and secured to a motor shaft of the motor.

2. The microwave oven of claim 1, wherein the motor is a non-reversible motor.

3. The microwave oven of claim 1, wherein the guide member has a hollow space in a length direction of the guide member, the length direction of the guide member being parallel to the first direction, the guide member being for guiding the pinion to move the antenna along the length direction of the guide member, the rack being on a sidewall surface of the hollow space.

4. A microwave oven, comprising:

a cooking chamber;

a magnetron for generating a microwave;

a waveguide for guiding the microwave from the magnetron toward the cooking chamber;

an antenna between the cooking chamber and the waveguide for propagating the microwave guided by the waveguide into the cooking chamber; and a driving unit for moving the antenna along a first direction and rotating the antenna, wherein the driving unit includes:

a motor to rotate the antenna;

a pinion rotatably connected to a shaft of the antenna;

a guide member on the waveguide, the guide member having a rack corresponding to the pinion to guide the pinion to reciprocally move the antenna along the rack in the first direction; and a slide member having the motor fixedly secured thereto, the slide member being slidably mounted between the guide member and the pinion, for supporting rotation and reciprocation of the pinion.

5. The microwave oven of claim 4, wherein the guide member and the slide member respectively include a guide groove and a guide projection that are complementary to each other for supporting the slide member on the guide member, and for sliding the slide member on the guide member.

* * * * *